US005465782A

United States Patent [19]

Sun et al.

[11] Patent Number: 5,465,782

[45] Date of Patent: Nov. 14, 1995

[54] HIGH-EFFICIENCY ISOTHERMAL HEAT PIPE

[75] Inventors: Jyi-Yu Sun; Tao Chian; Di-Kon Shih; Chih-Yao Wang, all of Hsinchu, Taiwan

[73] Assignee: Industrial Technology Research Institute, Taiwan

[21] Appl. No.: 259,003

[22] Filed: Jun. 13, 1994

[51] Int. Cl.[6] ..... F28D 15/00

[52] U.S. Cl. ..... 165/104.26; 165/104.33; 257/715; 361/700

[58] Field of Search ..... 165/104.33, 104.26, 165/104.21; 361/700; 257/715, 714

[56] References Cited

U.S. PATENT DOCUMENTS

| | | | |
|---|---|---|---|
| 4,118,756 | 10/1978 | Nelson | 361/700 |
| 4,737,839 | 4/1988 | Burt | 257/714 |
| 4,799,537 | 1/1989 | Hoke, Jr. | 165/32 |
| 4,805,691 | 2/1989 | Cook et al. | 165/104.26 |
| 4,815,529 | 3/1989 | Miyazaki et al. | 165/104.26 |
| 4,941,527 | 7/1990 | Toth et al. | 165/47 |
| 4,995,450 | 2/1991 | Geppelt et al. | 165/104.21 |
| 5,044,426 | 9/1991 | Kneidel | 165/32 |
| 5,309,986 | 5/1994 | Itoh | 165/104.33 |
| 5,331,510 | 7/1994 | Ouchi et al. | 165/104.33 |

FOREIGN PATENT DOCUMENTS

| | | |
|---|---|---|
| 0253141 | 1/1988 | Germany . |
| 0096992 | 6/1983 | Japan . |

*Primary Examiner*—John Rivell
*Assistant Examiner*—Christopher Atkinson
*Attorney, Agent, or Firm*—Pollock, Vande Sande & Priddy

[57] ABSTRACT

A high-efficiency isothermal heat pipe adapted for use in electronic equipment having a plate-like body with an enclosed inner chamber which has at least a dividing wall extending in the direction from the front end to the rear end of the body, separating the inner chamber into a plurality of zones which are interconnected by channels for the passage of a saturated working fluid filled in the inner chamber under a vacuum state. The dividing wall extends from the upper wall to the lower wall of the body and is integrally formed therewith so that the heat pipe may not distort in shape during the manufacturing process or when in use. The inner walls of the body have a plurality of grooves arranged between the front end and the rear end of the body for producing capillary action to quickly distribute heat.

4 Claims, 4 Drawing Sheets

HIGH-EFFICIENCY ISOTHERMAL HEAT PIPE

FIELD OF THE INVENTION

The present invention relates generally to an isothermal heat pipe, and more particularly to an isothermal heat pipe for use in electronic equipment.

BACKGROUND OF THE INVENTION

Because of the rapid development of the electronic industry in recent years, the demand for high-speed computing performance of electronic equipment and highly dense packing of integrated circuits on electronic blocks points to the trend of development for electronic equipment. An adverse effect of this trend is that the working temperature and heat density among electronic elements in the equipment will rise speedily during operation; consequently, the life and reliability of the electronic elements are reduced.

In electronic equipment, the working temperature of an element (e.g., an IC) itself as well as the working temperature among all the elements are not the same; some parts may produce very high temperatures. To distribute the heat generated in work by electronic elements or electronic equipment, the conventional method is to provide forced ventillation to distribute heat, or in some cases, water cooling devices are also employed in conjunction therewith to help distribute heat. But as mentioned above, there is the requirement for dense packing of electronic elements on boards to make the product more compact; therefore, the conventional method of using fans or water cooling devices to distribute heat is no longer suitable. There is a need to design a new heat pipe which does not occupy much space but can speedily distribute the heat generated in certain parts of the electronic equipment so that each electronic element stays at a relatively uniform working temperature, thus effectively maintaining the life and reliability of the electronic elements.

The technique of using heat pipes to distribute heat has been gradually adopted in certain equipment. But until now, conventional heat pipe structures cannot be directly applied to electronic equipment to solve the problem confronted by the electronic industry in its development. The reasons for this will be discussed hereinbelow.

The first publication of the principles and techniques of heat pipes was at Los Alamos Scientific Laboratory in 1964. As for the theory and practice of heat pipes, the book *Heat Pipe Theory and Practice* by S. W. Chi, McGraw-Hill, 1986, provides useful information.

Like conductive materials, heat pipes transfer heat from one place to another, but they have better thermal conductivity.

There are many inventions related to heat pipes and which were granted patent in the United States. Some of these are improvements on application techniques of conventional heat pipes, and reference may be made to their background of invention. These U.S. patents are discussed below:

U.S. Pat. No. 4,799,537 to Bryan C. Hoke, Jr. discloses a self-regulating heat pipe.

U.S. Pat. No. 4,941,527 to Toth et al. provides a sealed casing connected to an evaporator and a condenser in a heat pipe, forming a widening vapor flow passage from the evaporator to the condenser.

U.S. Pat. No. 4,995,450 describes a structure with internal spiraled grooves for enhanced thermal conductivity of the working fluids.

U.S. Pat. No. 5,044,426 to Kneidel teaches a heat pipe the interior thereof having a ligament for fixing a restriction member which extends from a noncondensible gas zone to a working fluid zone to reduce the internal cross-sectional area of the heat pipe.

The heat pipe is a hollow enclosed vessel which is made vacuum and then filled with a working fluid. When the heat pipe contacts a heat source, the temperature of the part of the heat pipe that is in contact with the heat source will rise. The absorbed heat will heat the working fluid in the vicinity of the inner wall of the part of the heat pipe in contact with the heat source until the working fluid is evaporated. At this time, the vapor pressure rises and pushes to the other areas of lower pressure, producing a vapor current flow, the vapor is then cooled and condensed to liquid, and by means of capillary structures, the condensed liquid is returned to the heated part of the heat pipe by capillary action. This liquid is again evaporated and the whole cycle is repeated. In this way, heat absorbed from a heat source by a certain part of the heat pipe is speedily distributed to the other parts thereof.

The capillary structures of prior plate type heat pipes include mainly the mesh capillary system and sintered metal layer system, wherein the mesh capillary system is by using metal coils or springs which extend within the heat pipe to secure the mesh tightly to the inner walls of the heat pipe, while in the sintered metal layer capillary system, a layer of metal powder is fixed on the inner walls of the heat pipe and is sintered in shape using a high temperature furnace. These two conventional capillary systems of heat pipes have their respective drawbacks as described below:

1. In adopting the mesh capillary system, metal coils must be used to support the mesh so that it tightly attaches to the inner walls of the heat pipe; this not only increases cost, but the capillary efficiency is also affected by the distance between the strings of the mesh. In fact, the mesh cannot be perfectly and uniformly attached to the inner walls of the heat pipe; the mesh is actually secured tightly to the inner walls in some parts and loosely in certain parts. Therefore, in practical use, the part where the mesh has loose contact with the inner wall, there is a relatively high heat resistance. Besides, this method of forming the mesh capillary structure does not allow the plate cross-section to have a length to width ratio that is too great.

2. In the sintered capillary system, since it is formed by sintering a layer of metal powder on the inner walls of the heat pipe, it is not suitable for use in a heat pipe with flat and wide inner walls. As is well known to those skilled in the art of sintering, it is not an easy job to evenly distribute metal powder grains on each cross section, not to say sintering them into shape.

Therefore, the reasons why conventional heat pipes cannot be directly applied to electronic equipment is because future electronic equipment requires a heat pipe that is thin and, preferably, has no restriction on the width or length. But the above-described conventional heat pipes cannot meet this requirement. Furthermore, a thin heat pipe must have good performance during the manufacturing process because it must be prevented from shrinking when it is made vacuum during the process. Besides, when it is in use and heated, it may not expand and distort in shape when its internal vapor pressure increases.

SUMMARY OF THE INVENTION

The primary object of the present invention is to provide an isothermal heat pipe for use in electronic equipment for speedily distributing heat generated by the electronic equipment, wherein the heat pipe is easy to manufacture and may not shrink in the process of manufacture or expand and distort in shape when in use.

Another object of the present invention is to provide a proper application of the isothermal heat pipe according to the present invention on electronic elements or electronic equipment.

BRIEF DESCRIPTION OF THE DRAWINGS

The foregoing and other features and advantages of this invention will be more clearly understood from the following detailed description and the accompanying drawings, in which.

DETAILED DESCRIPTION OF THE PREFERRED EMBODIMENTS

Figure 1:
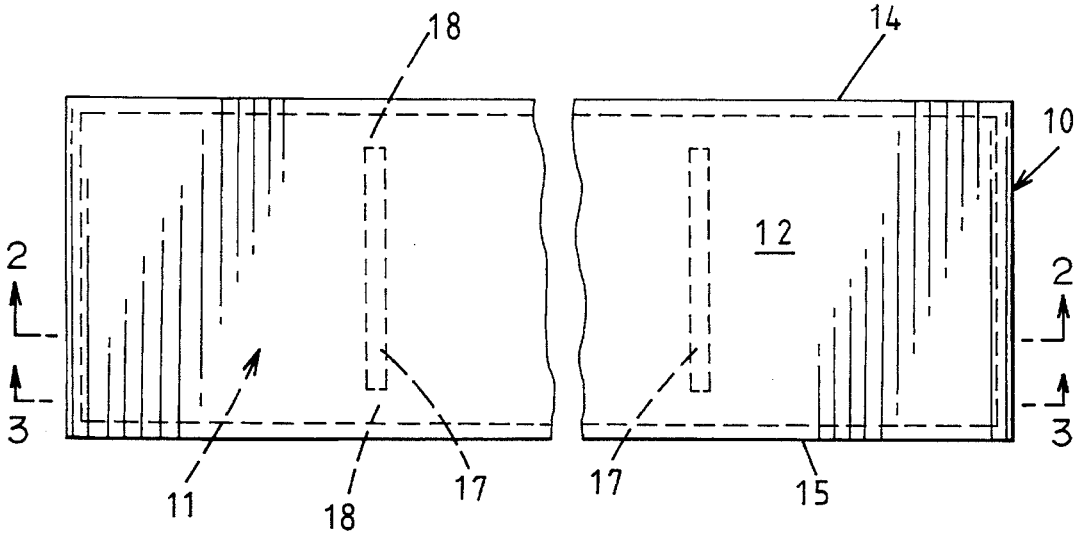
FIG. 1 is a top view of a preferred embodiment of the present invention.
Figure 2:
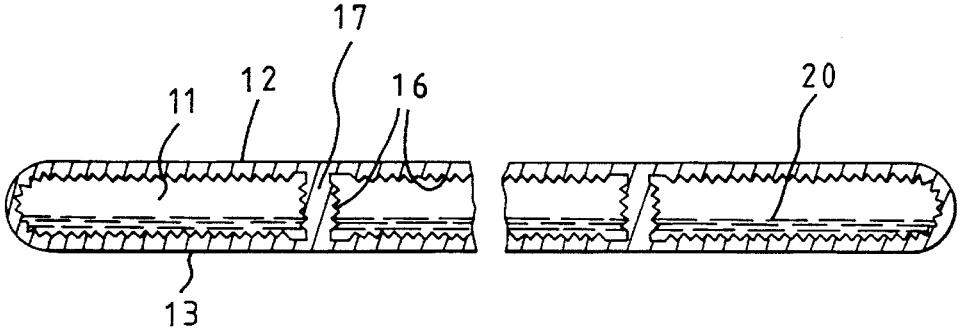
FIG. 2 is a sectional view taken along line 2—2 of FIG. 1.
Figure 3:
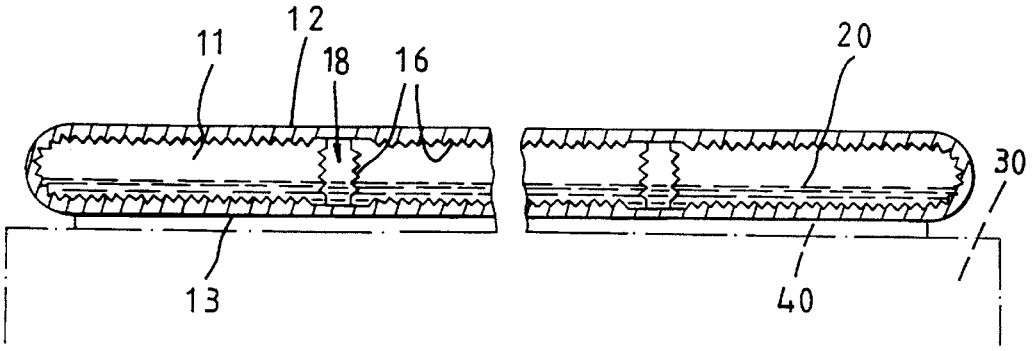
FIG. 3 is a sectional view taken along line 3—3 of FIG. 1; showing the preferred embodiment of the present invention in contact with the electronic equipment.

As shown in FIGS. 1, 2 and 3, the isothermal heat pipe according to the present invention comprises a plate body 10, its interior forming a hollow enclosed inner chamber 11, the body 10 having an upper wall 12 and a lower wall 13, and a front end 14 and a rear end 15, and the inner walls of the body 10 having a plurality of grooves 16 therein for producing capillary action, each of which extending from the front end 14 to the rear end 15; and at least a dividing wall provided in the inner chamber 11, extending in the direction from the front end 14 to the rear end 15 of the body 10 and running parallel to the grooves 16 of the body 10, but keeping a suitable distance from the front end 14 or rear end 15 of the body for forming a fluid channel 18. The dividing wall 17 extends from the upper wall 12 to the lower wall 13 of the body 10, dividing the inner chamber 11 into at least two fluid zones which are interconnected by the fluid channel 18.

The preferred embodiment in FIG. 1 shows that each dividing wall 17 respectively forms two channels 18 with the inner wall of the front end 14 and the inner wall of the rear end 15. The inner chamber 11, as shown in FIGS. 2 and 3, is filled with a working fluid 20 such as water, methanol, ethanol or refrigerant under the state of being vacuum. The working fluid 20 thus filled in the inner chamber 11 has a saturated liquid and vapor phase since it is in a vacuum environment. Vaporous working fluid in the body 10 moves in the inner chamber 11 according to different temperatures, while liquid working fluid moves along each groove by means of capillary action until heat in a certain area is quickly distributed to other areas.

FIGS. 2 and 3 show that the grooves are continuous toothed grooves, but it should be understood that such a configuration does not restrict the shape of the grooves according to the present invention. As a matter of fact, any shape of grooves may be adopted so long as they produce capillary action and extend in the direction from the front end 14 to the rear end 15 of the body 10. If desired, the two lateral sides of the dividing wall 17 may also be provided with a plurality of grooves which, preferably, run parallel to the grooves 16 in the inner walls of the body 10. The best mode is to have the dividing wall 17 extend from the upper wall 12 to the lower wall 13 and integrally formed with the body 10. This configuration not only prevents the upper wall 12 and the lower wall 13 from shrinking when air is pumped out of the inner chamber 11 to make it vacuum, but it also provides a resistance force to prevent the upper wall 12 and the lower wall 13 from expanding when the working fluid in the inner chamber 11 is heated and evaporated to cause the vapor pressure in the inner chamber 11 to rise.

FIG. 3 shows an application of the heat pipe of the present invention. Between the electronic equipment 30 (or electronic element) and the lower wall 13 of the heat pipe 10 is disposed a layer of heat-resisting and conductive glue substance 40 for filling the clearance therebetween. This arrangement enhances the efficiency of uniform distribution of heat.

Figure 4:
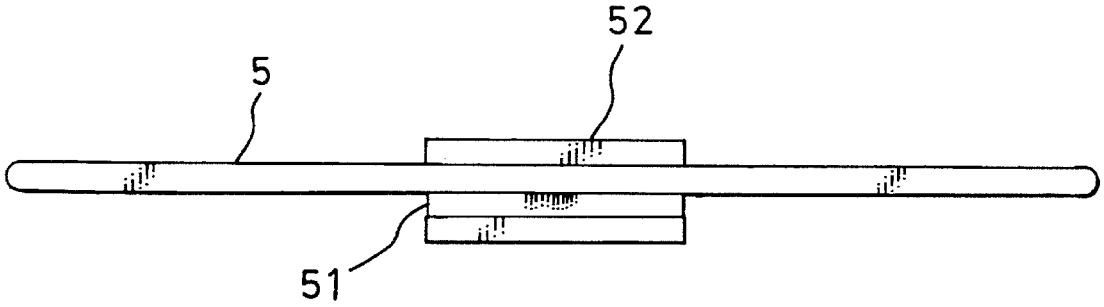
FIG. 4 is a schematic view of the isothermal testing method.
Figure 5:
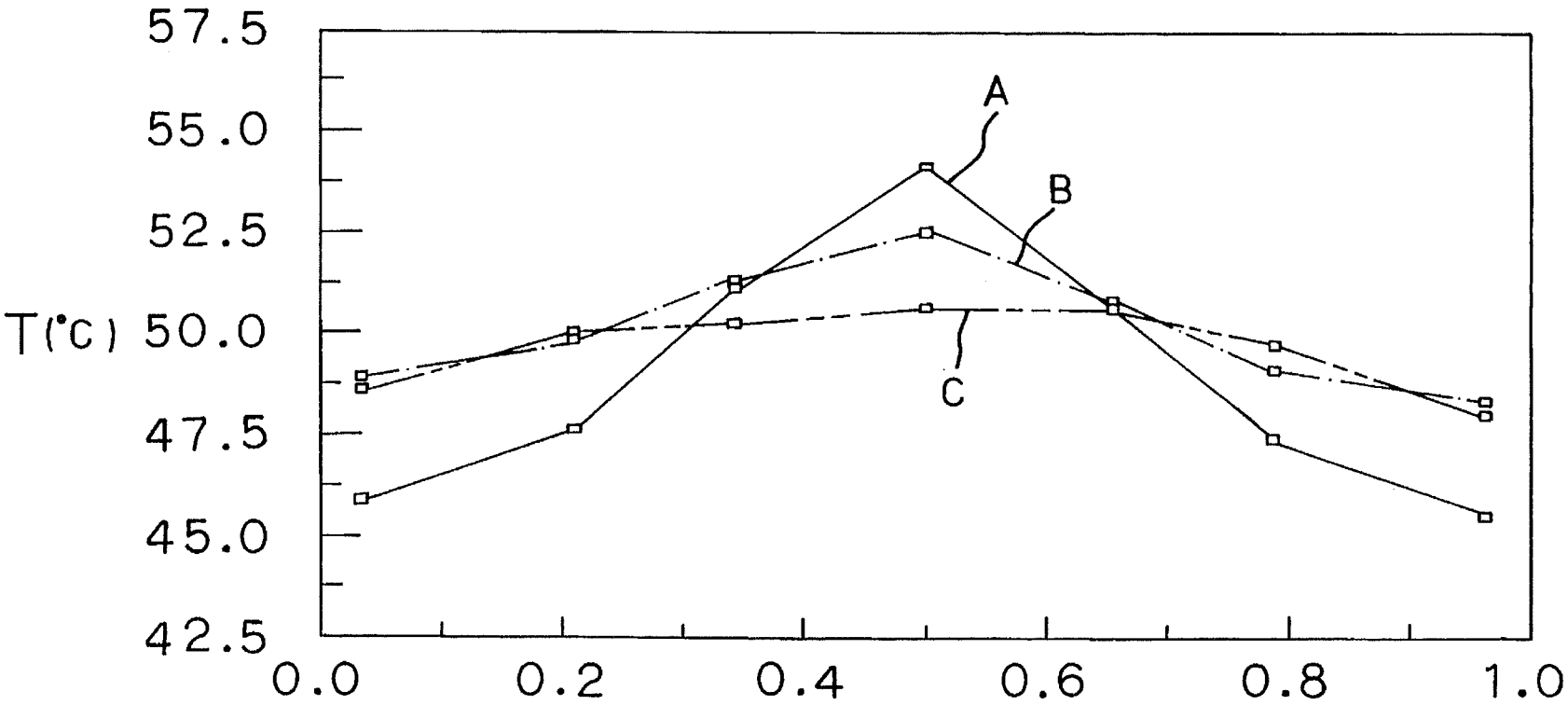
FIG. 5 and FIG. 6 are the respective curve diagrams of isothermal testing results.
Figure 6:
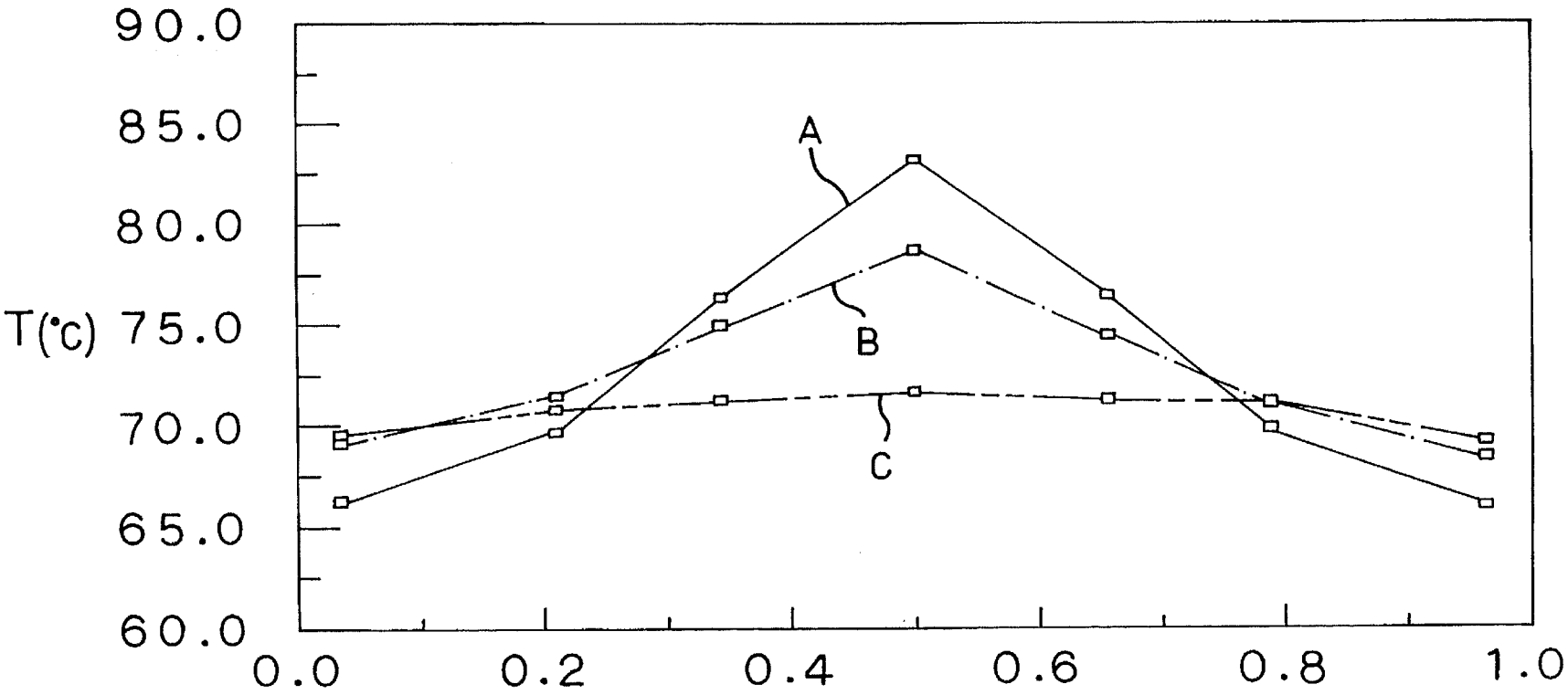

FIG. 4 shows the isothermal test method, and FIGS. 5 and 6 show the distribution condition of temperatures measured, wherein curve A represents a hollow aluminum plate; curve B represents a solid aluminum plate; curve C represents the above-described preferred embodiment according to the present invention. Likewise, the body of the preferred embodiment of the present invention is also made of aluminum. Each test sample 5 was, as shown in FIG. 4, placed on a chip 51 which generated heat; the test sample 5 and the chip 51 were then together maintained between insulated ceramic fiber pads 52; and the temperature value of the test sample 5 at each set point was taken horizontally. In FIG. 5, the curves were obtained using the chip 51 which supplied 4.5 w power; in FIG. 6, the power supplied by the chip was 9 w. Each test sample was substantially the same in shape, and their length (286 mm) and material are the same. The test sample according to the present invention had its inner chamber filled with 4.1 cc of acetone as working fluid.

From the temperature distribution shown in FIGS. 5 and 6, it can be understood that the temperature distribution of the preferred embodiment of the present invention was very quickly and uniformly, unlike curves A and B which show that the temperature distribution concentrated in the center to which heat was supplied. It can therefore be seen that the present invention really provides a plate type high-efficiency isothermal heat pipe. As for the number of dividing walls, it is closely related to the width and wall thickness of the body, and these are variations and modifications based on the present invention.

Although the present invention has been illustrated and described with reference to the preferred embodiments thereof, it should be understood that it is in no way limited to the details of such embodiments, but is capable of numerous modifications within the scope of the appended claims.

What is claimed is:

1. A high-efficiency isothermal heat pipe for use in electronic equipment to be in contact with electronic elements or electronic equipment composed of electronic elements so that heat generated in a certain part of the electronic elements may be speedily distributed through said heat pipe to prevent partial overheat in the electronic equipment, said heat pipe comprising:

a plate body, the interior thereof forming a hollow enclosed inner chamber, said body having an upper wall and a lower wall, a front end and a rear end, and inner walls with a plurality of grooves extending from said front end to said rear end for producing capillary action; and at least a dividing wall disposed in said inner chamber of said body, said dividing wall extending in the direction from said front end of said body to said rear end of said body and being parallel to said grooves in said inner walls of said body, while keeping a suitable distance from said front end of said body or said rear end of said body for forming a fluid channel, wherein said dividing wall extends from said upper wall of said body to said lower wall of said body to divide said inner chamber into at least two fluid zones which are interconnected by said fluid channel, and said inner chamber of said body is filled with a working fluid under a state of being vacuum.

2. A high-efficiency isothermal heat pipe for use in electronic equipment as claimed in claim 1, wherein a layer of heat-resisting and conductive glue substance is disposed between said heat pipe and said electronic equipment composed of electronic elements for filling the clearance therebetween.

3. A high-efficiency isothermal heat pipe for use in electronic equipment as claimed in claim 1, wherein said dividing wall is integrally formed with said body of said heat pipe.

4. A high-efficiency isothermal heat pipe for use in electronic equipment as claimed in claim 1, wherein said plurality of grooves are continuous toothed grooves.

* * * * *